US006820674B2

(12) United States Patent
Abita et al.

(10) Patent No.: US 6,820,674 B2
(45) Date of Patent: Nov. 23, 2004

(54) FAN SHADE

(75) Inventors: Charles J. Abita, Clinton Township, MI (US); James A. Ortisi, Roseville, MI (US)

(73) Assignee: Mary M. Abita, Clinton Township, MI (US)

( * ) Notice: Subject to any disclaimer, the term of this patent is extended or adjusted under 35 U.S.C. 154(b) by 0 days.

(21) Appl. No.: 10/395,789

(22) Filed: Mar. 24, 2003

(65) Prior Publication Data

US 2004/0188035 A1 Sep. 30, 2004

(51) Int. Cl.[7] ..... A47H 5/00

(52) U.S. Cl. ..... 160/84.07; 160/84.01; 160/370.21

(58) Field of Search ..... 160/84.07, 84.01, 160/370.21, 370.22, 370.23

(56) References Cited

U.S. PATENT DOCUMENTS

| | | | | | |
|---|---|---|---|---|---|
| 4,383,658 | A | * | 5/1983 | Morita et al. | 242/372 |
| 4,407,539 | A | * | 10/1983 | Asp | 292/338 |
| 4,934,436 | A | | 6/1990 | Schnebly | 160/84.1 |
| 5,002,112 | A | | 3/1991 | Schnebly et al. | 160/84.1 |
| 5,010,939 | A | | 4/1991 | King | 160/84.1 |
| 5,050,661 | A | | 9/1991 | Sikkema et al. | 160/84.1 |
| 5,117,889 | A | | 6/1992 | Coe | 160/134 |
| 5,168,912 | A | | 12/1992 | Jelic et al. | 160/84.1 |
| 5,183,092 | A | | 2/1993 | Jelic | 160/84.1 |
| 5,471,789 | A | * | 12/1995 | Faircloth | 49/74.1 |
| 5,584,329 | A | * | 12/1996 | Thomas | 160/134 |
| 5,660,220 | A | * | 8/1997 | Ruan | 160/84.07 |
| 5,662,153 | A | | 9/1997 | Rosenblatt | 160/84.07 |
| 5,765,619 | A | | 6/1998 | Arnold | 160/84.07 |
| 5,794,680 | A | * | 8/1998 | Xue | 160/84.07 |
| 5,857,493 | A | | 1/1999 | Matz | 138/110 |
| 6,029,733 | A | | 2/2000 | Xue | 160/84.07 |
| 6,145,569 | A | | 11/2000 | Shaw et al. | 160/84.07 |
| 6,192,967 | B1 | * | 2/2001 | Huang | 160/370.23 |
| 6,460,294 | B1 | * | 10/2002 | Harkins | 49/345 |
| 6,585,027 | B1 | * | 7/2003 | Roberts | 160/349.1 |
| 6,651,722 | B1 | * | 11/2003 | Fleishman et al. | 160/168.1 V |

* cited by examiner

*Primary Examiner*—Bruce A. Lev
(74) *Attorney, Agent, or Firm*—Young & Basile, P.C.

(57) ABSTRACT

An apparatus and method for selectively positioning a shade along an arcuate path to cover at least a portion of an arched window. The apparatus includes first member immovably associated and spaced from the arched window. The apparatus also includes a second member rotatingly associated with respect to the first member. The second member is rotatable between at least first and second angular positions to move the shade between an extended position and a retracted position. The apparatus also includes members for selectively positioning the shade along the arcuate path including a biasing member and a compressible member.

36 Claims, 5 Drawing Sheets

FAN SHADE

FIELD OF THE INVENTION

The present invention relates to an apparatus and method for positioning a shade relative to a window, and more particularly, to an apparatus and method for selectively positioning a fan shade along an arcuate path.

BACKGROUND OF THE INVENTION

Arched or semicircular windows are well known. Arched windows can be positioned above a door or positioned above a rectangular window. It can be desirable to position a shade to at least partially cover an arched window. A shade or blind positionable adjacent an arched window can be moveable between an extended position and a retracted position. In the retracted position, the shade can define one or more folds.

When positioned adjacent an arched window, the shade can be moveable along an arcuate path adjacent the arched window to cover at least a portion of the arched window. However, known devices for moving a shade or blind along an arcuate path to cover at least a portion of an arched window are not as efficient as desired. In particular, known devices are too complicated and costly or too ineffective and unreliable to selectively position the shade along the arcuate path as desired.

SUMMARY OF THE INVENTION

The present invention provides an apparatus and method for selectively limiting movement of a shade along an arcuate path to cover at least a portion of an arched window. The invention includes a first member having an aperture and a second member insertable with respect to the aperture. The first member can be immovably positioned with respect to the window and the second member can rotate relative to the first member. The invention also includes means for limiting the rotation of the second member with respect to the first member. The means for limiting rotation of the second member can include a biasing means such as a spring for biasing the second member with respect to the first member. The limiting means can include means for frictionally engaging the first member with respect to the second member. Limiting means can be a gasket-like structure and can be concentrically disposed with respect to the second member.

Limiting means can include a weighted member connected to the second member. The weighted member can be positioned such that the likelihood of rotation of the second member is reduced. Limiting means can alternatively include a stop engagable with the second member. The stop can be selectively extended and retracted with respect to the second member to adjust the extent of travel along the arcuate path.

The invention can be practiced with second and third members rotatingly associated with respect to the first member. One or more shades can be operably associated with each of the second and third members. For example, a first shade can be associated with the second member and be moved along an arcuate path to cover a first half of the arched window. A second shade can be operably associated with the third member and be movable along an arcuate path to cover a second half of the arched window. The invention can include means for concurrently rotating the second and third members to open and close the first and second shades at the same time.

The first member can be shaped to define a first arcuate portion and a second arcuate portion. The first arcuate portion can be the same size or differently sized relative to the second arcuate portion. The arcuate portions can enhance movement of the shade by guiding the shade. The shade can be positioned between the arcuate portions. Alternatively, the first member can include only a first arcuate portion. A shade can be positioned between the first arcuate portion and the window to enhance movement of the shade.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Various embodiments of the invention are shown throughout the figures. The figures include common elements in different structural configurations. Common elements are designated with a common base numeral and differentiated with an alphabetic designation.

Figure 1:
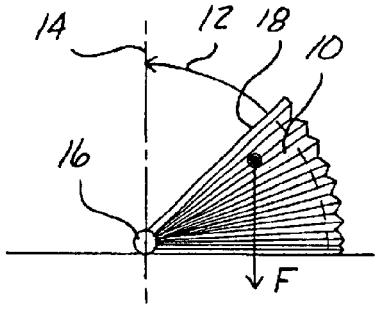
FIG. 1 is a schematic view of a shade positioned along an arcuate path wherein the arcuate path extends substantially ninety degrees.

Referring now to FIG. 1, a shade 10 can be movable along an arcuate path 12. The shade 10 can be sized to extend from a retracted position to an extended position. The arcuate path 12 can extend substantially 90° and the extended position of the shade can correspond to a position the vertical axis 14. The retracted position of the shade 10 can correspond to 0° along the arcuate path and define a one or more folds. The arcuate path 12 defines a radius with respect to a center of rotation 16. The shade 10 can be operably associated with respect to a member 18. The member 18 can be rotated with respect to the center 16 and pull or draw the shade into the extended position. In FIG. 1, the shade 10 is intermediate between the extended position and the retracted position. At any point along the arcuate path, naturally occurring forces F can tend to induce rotation of the member 18 in a direction to tend to move the shade 10 to the retracted position or the extended position. In FIG. 1, the forces F are tending to induce the shade 10 to the retracted position. These forces F can include gravity acting on the mass of the shade 10 and the mass of the member 18 as well as restoration or recoiling forces that can be defined by the folds of the shade 10.

Figure 2:
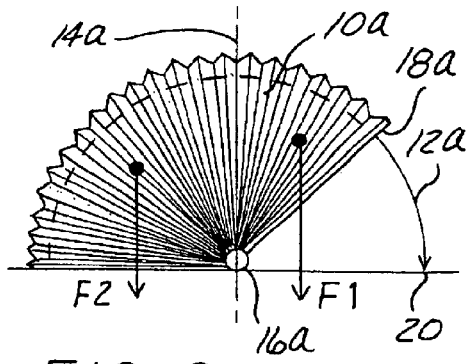
FIG. 2 is a schematic view of a shade positioned along an arcuate path, wherein the arcuate path extends substantially one hundred and eighty degrees.

Referring now to FIG. 2, a shade 10*a* can move along a semicircular arcuate path 12*a*. The arcuate path 12*a* can extend substantially 180°. The vertical axis 14*a* can define a midpoint of movement of the shade 10*a* along the arcuate path 12*a*. The retracted position of the shade 10*a* can correspond to 0° along the arcuate path 12*a* and define a one or more folds. The arcuate path 12*a* defines a radius with respect to a center of rotation 16*a*. The extended position of the shade 10*a* can correspond to 180° along the arcuate path 12*a*. The shade 10*a* can be operably associated with respect to a member 18*a*. The member 118*a* can be rotated with respect to the center 16*a* and pull or draw the shade 10*a* into the extended position. In FIG. 2, the shade 10*a* is intermediate between the extended position and the retracted position. At any point along the arcuate path 12*a* between an axis 14*a* and an end 20 of the path 12*a*, forces $F_1$ can act on the shade tending to induce rotation in a direction to fully extend the shade 10*a*. In addition, forces $F_2$ can act on the shade tending to induce retraction of the shade 10*a*.

Figure 3:
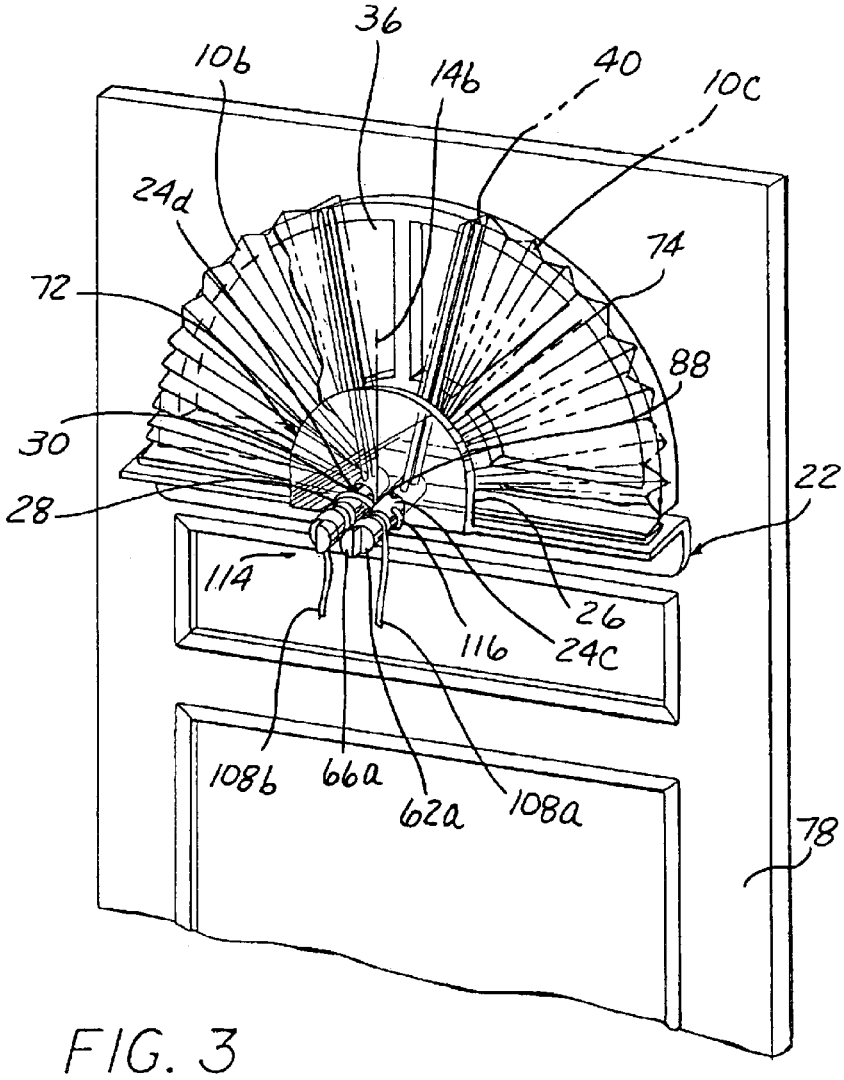
FIG. 3 is a perspective view of a first member positioned adjacent an arched window, wherein the arched window is positionable with respect to a door.
Figure 5:
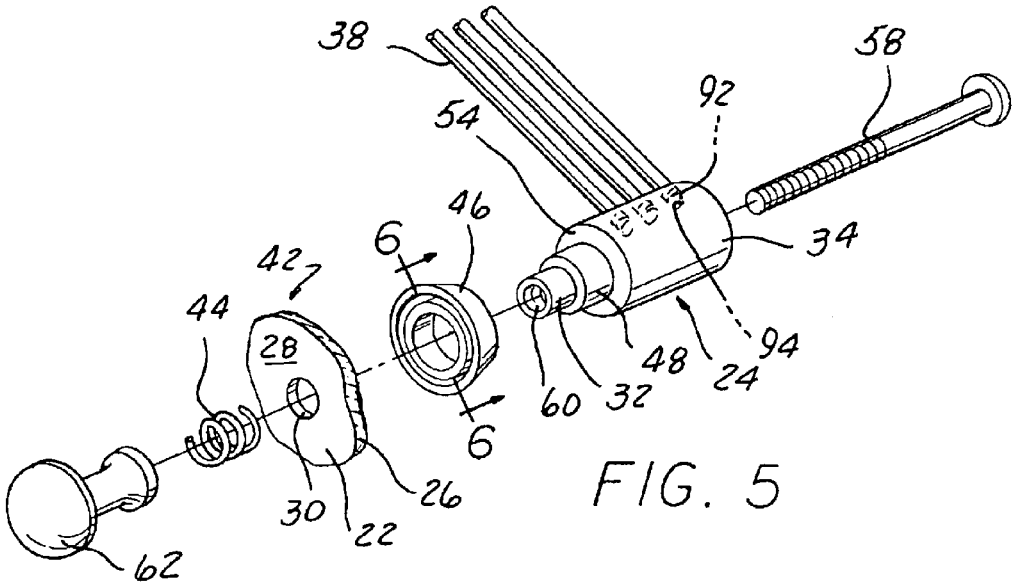
FIG. 5 is an exploded view of an embodiment of limiting means.

Referring now to FIGS. 3 and 5, the present invention provides an apparatus and method for selectively positioning a shade along an arcuate path including a first member 22 and a second member 24. The first member 22 includes a first side 26, a second side 28 and at least one aperture 30. The first member 22 can include a first arcuate portion 72. The portion 72 can define a radius 74. The radius 74 can be concentric with respect to a radius of the arched window 36. For example, the center of the radius 74 and the center of the radius defined by the arched window 36 can be positioned along an axis extending substantially perpendicular with respect to the arched window 36. The arcuate portion 72 can define a plane substantially parallel to the arched window 36. One or more shades 10*b*, 10*c* can be positioned between the first arcuate portion 72 and the arched window 36. The aperture 30 can be disposed generally centric with respect to the arcuate portion. Alternatively, a plurality of apertures can be a predetermined distance apart from one another, the position of the plurality of apertures can be generally centered with respect to the first arcuate portion. For example, the member 22 can include a first aperture 30 and a second aperture 88 for receiving the second member 24*c* and a third member 24*d*, respectively, and be mirrored with respect to and axis 14*b*.

Figure 4:
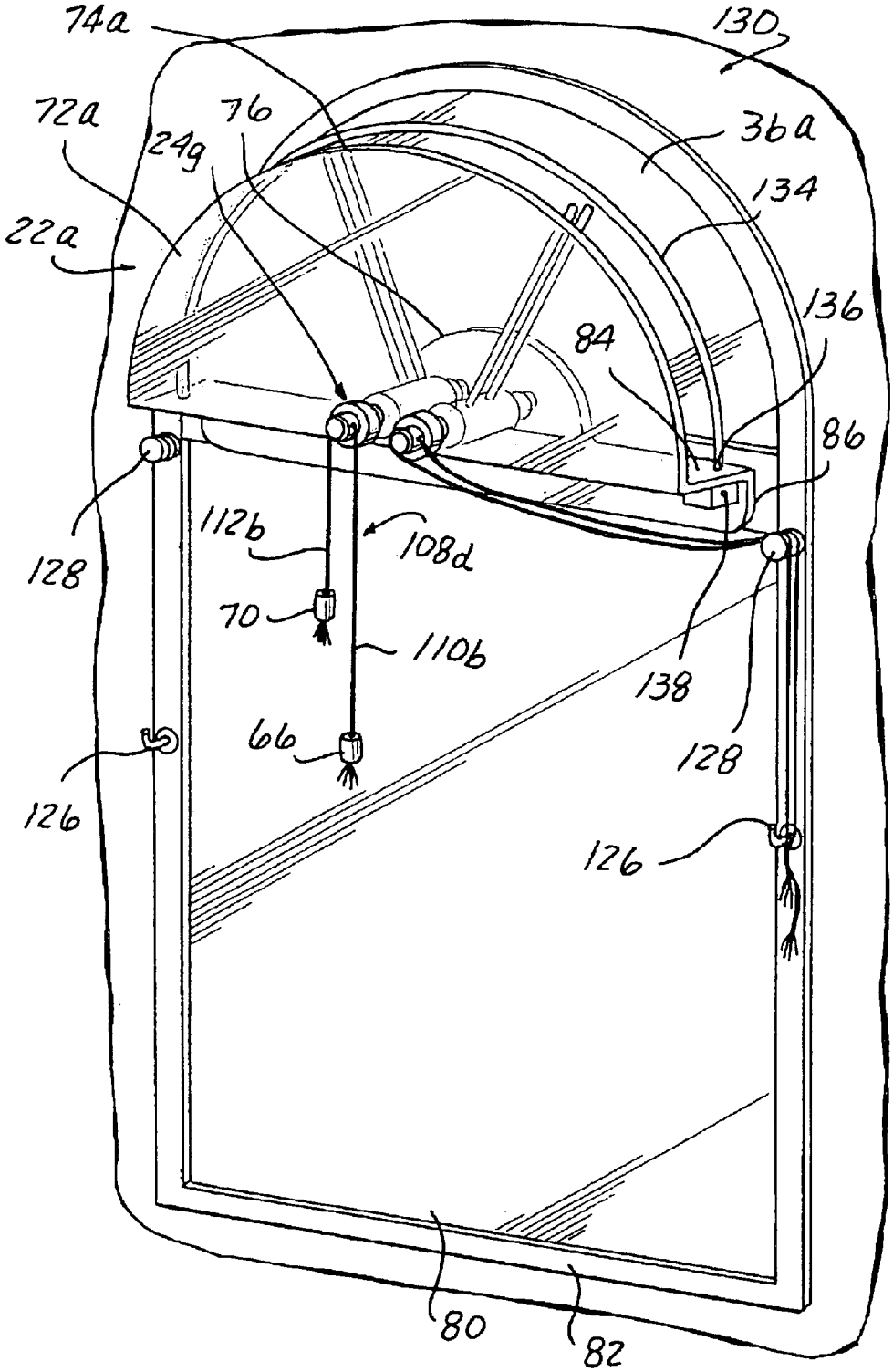
FIG. 4 is a perspective view of a second embodiment of a first member positioned adjacent an arched window, wherein the arched window is positionable with respect to a substantially rectangular window and the invention includes a guide rail disposed between the first member and the arched window.

Referring now to FIG. 4, a first member 22*a* can include an arcuate portion 72*a* defining a radius 74*a* substantially equal to or less than a radius defined by an arched window 36*a*. The first member 22*a* can also include a second arcuate portion 76. The first and second arcuate portions 72*a*, 76 can be sized differently with respect to one another or can be sized similarly. The first and second arcuate portions 72*a*, 76 can individually define planes substantially parallel to one another. One or more shades (not shown) can be positioned between the first arcuate portion 72*a* and the second arcuate portion 76.

Referring now to FIGS. 3 and 4, the first member can be immovably associated with respect to an arched window. In FIG. 3, the first member 22 can be mounted or engaged with respect to a door 78. Alternatively, the member 22 can be positioned above the door 78 such that the member 22 is immovably positioned adjacent the arched window 36. In FIG. 4, the member 22*a* is positioned adjacent the top of a window 80. The member 22*a* can be mounted with respect to a frame 82 of the window 80 on an outer facing surface of the frame 82 or and upwardly facing surface of the frame 82.

The member 22*a* can include a portion 84 extending generally parallel with respect to the window 36*a* and a projection 86 extending transverse with respect to the portion 84. The portion 84 can be immovably associate with one edge of the shade and support the shade when the shade is in a retracted position. The projection 86 can engage the frame 82. Alternatively, the member 22*a* can include only a portion 84 engageable with respect to the frame 82. The member 22*a* can be formed from plastic in any conventional molding process including vacuum forming, blow molding, or injection molding. Preferably, the member 22 or 22*a* is transparent.

Referring now to FIGS. 2–3 and 5, the second member 24 can include a first portion 32 insertable with respect to the aperture 30 and positionable adjacent the second side 28 of the first member 22. The second member 24 can include a second portion 34 positionable adjacent the first side 26 of the first member 22. The second member 24 is rotatable relative to the first member 22 between at least a first angular position and a second angular position. The first angular position of the second member 24 can correspond to a retracted position of the shade 10*b*. The second angular position of the second member 24 can correspond to an extended position of the shade 10*a*. The extended position of the shade 10*a* can correspond to 90° of movement along an arcuate path or 180° of extension of movement along an arcuate path. In other words, the shade 10*a* can extend to cover half of an arched window or cover substantially all of the arched window 36.

The second member 24 can be formed in any material desirable. For example, the second member 24 can be formed from metal or wood. Alternatively, the second member 24 can be formed from plastic in any conventional molding process including vacuum forming, blow molding, or injection molding. The member 24 can be extruded. Preferably, the member 24 can be transparent.

Figure 4A:
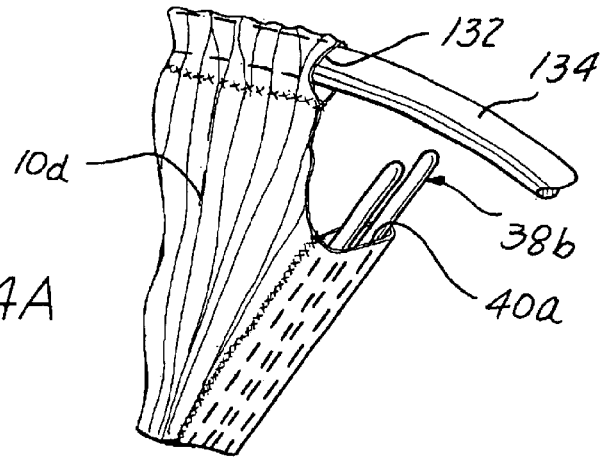
FIG. 4A is a perspective, partial cut-away view of a tip of guide fingers for moving a shade along an arcuate path.

Referring now to FIGS. 4A and 5, the second member 24 can also include one or more fingers 38 extending substantially transverse with respect to a longitudinal axis of the second member 24. The fingers 38 can extend from the second portion 34 of the second member 24. The fingers 38*b* can engage a leading edge 40*a* of the shade 10*d* and draw or move the edge 40*a* between the extended position and the retracted portion when the second member 24 is rotated relative to the first member 22. The edge 40*a* can be formed as a sleeve and the fingers 38*b* can extend internal with respect to the sleeve 40*a*. Alternatively, the fingers 38*b* can be engaged with respect to the edge 40*a* by any means including fasteners, adhesive, or any combination thereof. A longitudinal axis of the fingers 38 can be offset with respect to the longitudinal axis of the second member 24, best shown by fingers 38*a* and FIG. 8.

Referring now to FIG. 5, the fingers 38 can be threadingly engaged with respect to the second member 24. For example, the fingers 38 can define a threaded end portion 92 and the second member 24 can define a thread aperture 94 for receiving the portion 92. The fingers 38 can be selectively positioned with respect to the second member 24 to support a plurality of differently configured shades. The fingers 38 can defined threads along the entire length of the fingers 38 and can receive a member defining internal threads to engage external threads defined by the fingers 38. The member defining internal threads can extend the effective length of the the fingers 38 so that the fingers 38 can be manufactured in one size and support shades defining widths substantially greater than the length of the fingers 38. Alternatively, the fingers 38 can be engaged with respect to the second member 24 with adhesive. Preferably, the fingers 38 can be transparent.

Figure 7:
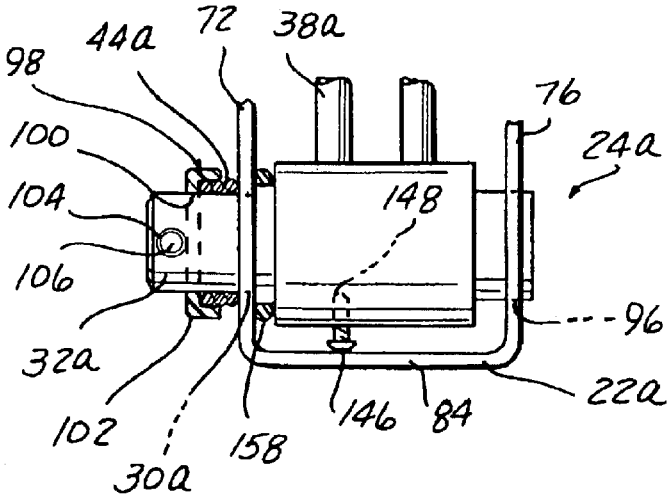
FIG. 7 is a cross-sectional view of a second embodiment of limiting means.

Referring now to FIG. 7, the second member 24*a* can be insertable with respect to the aperture 30*a* defined by the first member 22*a*. The aperture 30*a* can be defined by the first arcuate portion 72. The second member can be insertable with respect to a plurality of apertures defined by the first member. For example, the second member 24*a* can be received by apertures 30*a* and 96. The support of the second member 24*a* by the member 22*a* can be enhanced by inserting the second member 24*a* with respect to a plurality of apertures such as apertures 30*a*, 96.

Figure 12:
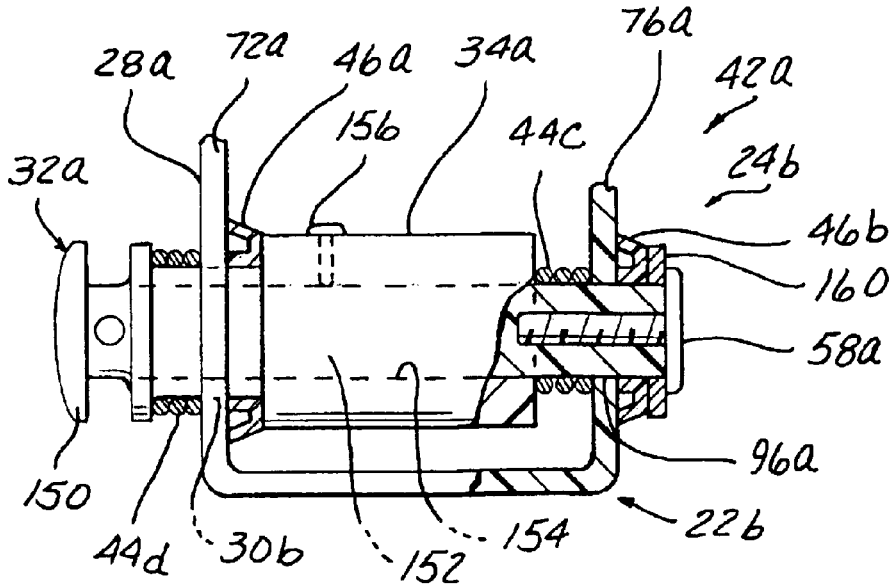
FIG. 12 is a cross-sectional view of a third embodiment of limiting means.

Referring now to FIG. 12, a second member 24*b* can include a first portion 32*a* and a second portion 34*a* removably engagable with respect to one another. First portion 32*a* can include a gripping portion 150 adjacent a second side 28*a* of the first member 22*b*. The first portion 32*a* can include a body portion 152 extending from the gripping portion 150. The body portion 152 can be insertable with respect to an aperture 30*b* defined by the arcuate portion 72*a* of the member 22*b*. The body portion 152 can also be insertable with respect to an aperture 154 defined by the second portion 34*a*. The body portion 152 can also be insertable with respect to an aperture 96*a* defined by an arcuate portion 76*a* of the member 22*b*. The second portion 34*a* can be immovably associated with respect to the first portion 32*a*. The second member 24*b* can include one or more fasteners 156 insertable with respect to the second portion 34*a* and engageable with the first portion 32*a* to immovably associate the second portion 34*a* with respect to the first portion 32*a*. Fingers, such as fingers 38 in FIG. 5, can also be operable to immovably associate the second portion 34*a* with respect to the first portion 32*a*.

Figure 6:
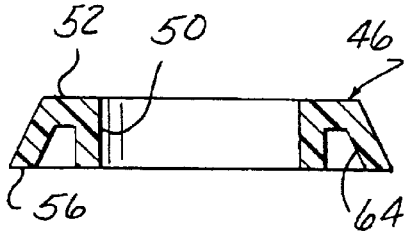
FIG. 6 is a sectional view of a compressible member.

Referring now to FIGS. 5 and 6, the invention also includes means 42 for limiting rotation of the second member 24 with respect to the first member 22 to selectively position the shade along an arcuate path. Limiting means 42 can include means 44 for biasing one of the first portion 32 and second portion 34 with respect to the first member 22. For example, biasing means 44 can be a spring biasing the first portion 32 away from the first member 22 and biasing the second portion 34 toward the first member 22. The first portion 32 can be inserted with respect to the aperture 30. Prior to insertion of the first portion 32 a compressible member 46 can be engaged with respect to the second member 24. A shoulder 48 can be received in an aperture 50 of the compressible member 46. A surface 52 of the compressible member 46 can engage a surface 54 of the second portion 34. A surface 56 of the compressible member 46 can engage the first side 26 of the first member 22.

Biasing means 44 can be concentrically disposed with respect to the first portion 32 after the first portion 32 has been inserted with respect to the aperture 30. A fastener 58 can be inserted with respect to the aperture 30. In particular, a fastener 58 can be inserted with respect to an aperture 60 defined by the second member 24 and be received by a fixture 62. The fastener 58 and fixture 62 can threadingly engage and at least partially compress biasing means 44 as well as compressible member 46. The fixture 62 can be sized larger than biasing means 44 to prevent biasing means 44 from disengaging with respect to the first portion 32.

Figure 8:
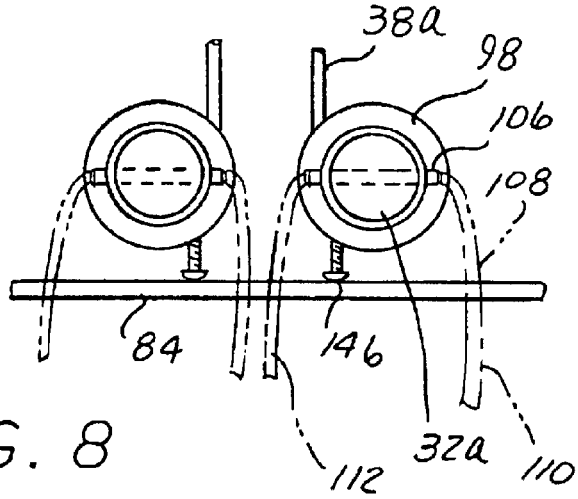
FIG. 8 is a front view of the limiting means shown in FIG. 7.

Referring now to FIGS. 7 and 8, the second member 24*a* can also include a cap 98 engageable with respect to biasing means 44*a*. After the first portion 32*a* has been inserted with respect to the aperture 30*a*, the first portion 32*a* can be inserted with respect to an aperture 100 defined by the cap 98. The cap 98 can include a tubular portion 102 engageable with respect to biasing means 44*a*. The first portion 32*a* can define an aperture 104 extending transverse with respect to the longitudinal axis of the second member 24*a* for receiving a pin 106. The pin 106 can be sized to be greater than the diameter of the second portion 32*a* and greater than the aperture 100. The pin 106 can prevent separation of the cap 98 and biasing means 44 with respect to the second portion 32*a*.

Referring now to FIGS. 5 and 6, the compressible member 46 can be fabricated from any elastomeric material such as rubber or urethane. The compressible member 46 can be fabricated from material resistant to ultraviolet light and sunlight to reduce the likelihood of cracking and drying-out of the compressible member 46. The surface 56 and the first side 26 can frictionally engage one another and the surface 52 frictionally can frictionally engage the surface 54. The compressible member 46 defines channel 64 having an opening generally transverse relative to a longitudinal axis of the second member 24 when the compressible member 46 is engaged with respect to the second member 24.

Referring now to FIG. 12, means 42*a* can include a plurality of biasing means 44*b*, 44*c* and compressible members 46*a*, 46*b*. A pair of first biased means 44*b* and compressible member 46*a* can be disposed on one side of the second portion 34*a* and a second set of a biasing means 44*c* and compressible member 46*b* can be disposed on an opposite side of the second portion 34*a*. A fastener 58*a* and washer 160 can be engaged with respect to an end of the body portion 152 opposite the gripping portion 150 to at least slightly compress the biasing means 44*b*, 44*c* and compressible members 46*a*, 46*b*.

Referring now to FIGS. 5 and 6, Means 42 can be configured such that the frictional engagement between the compressible member 46 and the first member 22 and the second member 24 is slightly greater than the natural forces tending to induce rotation of the second member 24. In particular, an operator of means 42 can easily rotate the fixture 62 to extend or retract the shade. However, after the force applied by the operator has been removed, the frictional engagement between the compressible member 46 and the first member 22 as well as between the compressible member 46 and the second member 24 will substantially prevent further rotation of the second member 24.

The frictional forces can be 1% to 5% greater than the naturally occurring forces, 5–20% greater than the naturally occurring forces, or 20–30% greater than the naturally occurring forces. The naturally occurring forces can be small since the shade and fingers can be relatively light-weight. Therefore, the frictional forces can be in excess of 30% greater than naturally occurring forces as long as the force required to overcome the frictional forces and turn the second member is not significantly greater than the strength of a typical operator. As the size of the shade increases, the extent of the frictional forces relative to the naturally occurring forces will diminish or decrease. For example, in an embodiment of the invention wherein the shade and fingers are relatively large and/or heavy, the frictional forces can be 1% to 5% greater than the naturally occurring forces. In an embodiment of the invention wherein the shade and fingers are relatively small and/or light-weight, the frictional forces can be in excess of 30% greater than the naturally occurring forces.

The frictional forces can be modified by altering the configuration of biasing means, the compressible member and the second member. For example, the biasing means or spring 44 can be altered with respect to length, the number of coils, and the material from which the spring 44 is fabricated to modify the strength of the spring 44. The compressible member 46 can be altered with respect to width or diameter, profile and the material from which the compressible member is fabricated. For example, the compressible member 46 can be an o-ring 158, as shown in best FIG. 7.

The invention can also include means for engaging the second member to rotate the second member with respect to the first member. As shown in FIG. 5, engaging means can be a fixture 62 such as a handle or a knob. As shown in FIGS. 7 and 8, the first portion 32*a* can define the aperture 104 and receive a pin 106. The pin 106 can be substantially tube-like and receive a flexible member 108. The member 108 can be immovably associated with respect to the pin 106. The member 108 can be desirable to rotate the second member 24*a*. For example, an operator can pull a first portion 110 of the member 108 to rotate the second member 24*a* in a clockwise direction and move the shade to a retracted position. The operator can pull a second portion 112 of the member 108 to rotate the second member 24*a* in a counter-clockwise direction and move the shade to an extended position.

The invention can include two members rotatably mounted with respect to the first member, each member operably associated with a shade, as well as means for concurrently rotating the two members. Referring now to FIG. 3, means 114 for concurrently rotating a second member 24*c* and a third member 24*d* can include a first flexible member 108*a* operably associated with the second member 24*c* and a second flexible member 108*b* operably associated with the third member 24*d*. The first flexible member 108*a* encircles the second member 24*c* a predetermined number of revolutions and the second flexible member 108*b* encircles the third member 24*d* a predetermined number of revolutions. Means 114 can also include member 116 engaged with respect to both the second member 24*c* and the third member 24*d*. The member 116 partially encircles both the second member 24*c* and the third member 24*d*, forming an S-shape when viewed along an edge of the member 116. The member 116 can be a sheet-like member or a ball-chain. When both shades are in the extended position, an operator can pull one of the first flexible member 108*a* and the second flexible member 108*b* to unwind the one of the first flexible member 108*a* and the second flexible member 108*b* with respect to the corresponding second member 24*c* or third member 24*d* and rotate the corresponding second member 24*c* or the third member 24*d*. For example, in response to rotation of the third member 24*d* in a first angular direction, the second member 24*c* can rotate in a second angular direction where the second angular direction is opposite of the first angular direction. Rotation is communicated by the member 116.

Figure 9:
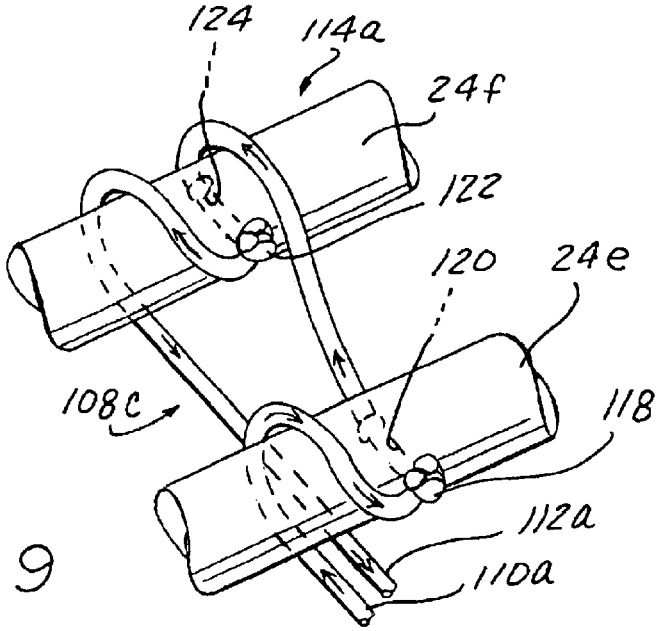
FIG. 9 is an embodiment of the invention for concurrently rotating second and third members relative to a first member.
Figure 10:
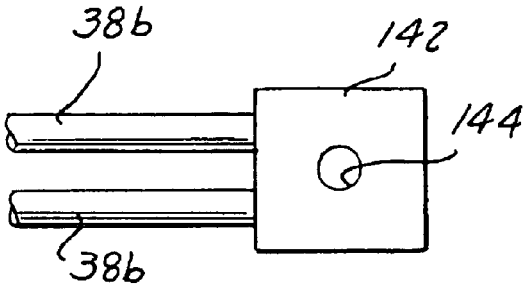
FIG. 10 is a top plan view of a member for operably associating fingers with the rail.
Figure 11:
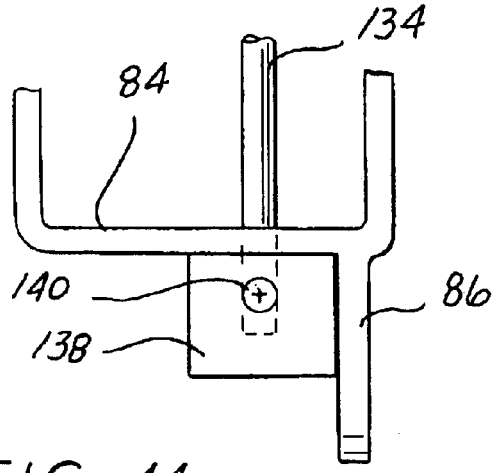
FIG. 11 is a side view of a mounting configuration for engaging the rail with respect to the first member.

Referring now to FIG. 9, an alternative embodiment of means for concurrently rotating the two members is shown. In particular, means 114*a* can include a flexible member 108*c*. The member 108*c* can encircle and engage a second member 24*e* and a third member 24*f*. A first portion 110*a* of the member 108*c* can pass an underside of the member 24*e*, wrap around a portion of the member 24*e* and form a knot 118. The member 108*c* can extend from the knot 118 through an aperture 120 defined by the member 24*e* and extending substantially transverse with respect to a longitudinal axis of the member 24*e*. The member 108*c* can extend from the aperture 120, pass an over a topside of the member 24*f*, wrap around a portion of the member 24*f*, pass through an aperture 124 defined by the member 24*f* and extending substantially transverse with respect to a longitudinal axis of the member 24*f*, and form a knot 122. A second portion 112*a* of the member 108*c* can extend from the knot 122, pass a topside of the member 24*f*, wrap around and pass an underside of the member 24*e*. An operator can pull one of the first and second portions 110*a*, 112*a* to rotate the second and third members 24*e*, 24*f* concurrently.

Referring now to FIG. 4, limiting means can also include a weighted member 66 operably associated with the first portion 32*a* of the second member 24*a*. The weighted member 66 can be operably associated with the first portion 110*b* or the second portion 112*b* of the flexible member 108*d*. For example, the member 66 can be engaged with the first portion 110*b* to apply a force acting against naturally occurring forces tending to induce rotation of the member 24*g* in a counter-clockwise direction, moving a shade associated with the member 24*g* to a retracted position. A member 70 can be operably associated with a second portion 112*b* of the member 108*d* and appear substantially similar with respect to the weighted member 66. However, the member 70 can be configured to weigh less than the weighted member 66. Alternatively, a weight member 66*a* can be integrally formed or engaged with respect to a fixture 62*a*, as shown in FIG. 3.

Referring now to FIG. 4, the invention can include a fastener 126 such as a hook to position the flexible members out of the field of vision defined by the window 80. The invention can also include pulleys 128 for guiding movement of a flexible member operable to rotate one of the second member and the third member.

Referring now to FIGS. 7 and 8, limiting means can include a stop 146 engageable with the second member 24*a* and the first member 22*a*. The stop 146 can extend transverse with respect to a longitudinal axis of the second member 24*a* and be offset with respect to the longitudinal axis of the second member 24*a*. When the second member 24*a* has rotated to a predetermined angular position, the stop 146 can engage the portion 84 of the first member 22*a* and prevent further rotation of the second member 24*a*. The stop 146 can include threads and be threadingly received in an aperture 148 defined by the second member 24*a*. The stop 146 can extend from the second member 24*a* a selective distance by varying the threading engagement between the stop 146 and the second member 24*a*.

Referring now to FIGS. 4, 4A, 10 and 11, the invention can also include means 130 for guiding movement of a periphery of the shade along the arcuate path. Means 130 can include a sleeve 132 defined by the shade 10*e*. The sleeve 132 can receive an arcuate rod 134 immovably associated with respect to the first member 22*a*. The rod 134 can be engaged with the first member 22*a* at both ends of the rod 134. The rod 134 can pass through an aperture 136 defined by the portion 84 and engage a mounting block 138. The rod 134 can be engaged with the mounting block 138 with a fastener 140 such as a screw. A guide 142 can be disposed at an end of the fingers 38*b* positioned in a sleeve 40*a* and define an aperture 144 for receiving the rod 134.

The first member can define a window pane and the second member can be disposed between first and second window panes. The second member can move a shade disposed between the window panes along an arcuate path disposed between the window panes. The path can define a retracted position and an extended position with respect to the shade. Limiting means can be positioned between the second member internal with respect to the window defined by the first member.

The inventive fan shade has been described in connection with an arched window. However, the fan shade and the means for limiting movement of the fan shade can be used with any configuration of window. In particular, the shade can be configured to cover any shape of window by selectively determining a width of the shade for each individual fold of the shade.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An apparatus for positioning a shade along an arcuate path comprising:

a first member defining a first side, a second side and an aperture extending between the first and second sides;

a second member engageable with the shade, insertable with respect to the aperture, rotatable between at least a first angular position and a second angular position with respect to the first member, and having a first portion positionable adjacent the first side of the first member and a second portion positionable adjacent the second side of the first member;

means for limiting rotation of the second member with respect to the first member; and wherein said limiting means includes a stop engageable with respect to one of the first portion and the second portion and extending substantially transverse with respect to the one of the first portion and the second portion.

2. The apparatus of claim 1 wherein said limiting means further comprises:

means for biasing one of the first portion and the second portion with respect to the first member.

3. The apparatus of claim 2 wherein said biasing means biases the one of the first portion and the second portion away from the first member.

4. The apparatus of claim 1 wherein said limiting means further comprises:

means for frictionally engaging one the first member and the second member.

5. The apparatus of claim 4 wherein said engaging means is operable to frictionally engage the first member with respect to the second member.

6. The apparatus of claim 1 wherein said limiting means is disposed concentrically with respect to the second member.

7. The apparatus of claim 1 wherein said limiting means is compressible.

8. The apparatus of claim 1 further comprising:

a shade engageable with one of the first portion and second portion and movable between an extended position and a retracted position in response to rotation of the second member wherein the first position corresponds to one of the extended position and the retracted position and the second position corresponds to the other of the extended position and the retracted position.

9. The apparatus of claim 8 further comprising:

at least one finger extending substantially transversely with respect to the second member and engageable with the shade.

10. The apparatus of claim 1 wherein said limiting means further comprises:

a weighted member operably associated with an end of one of the first portion and the second portion.

11. The apparatus of claim 10 wherein the weighted member is operably associated with the end with a flexible member.

12. The apparatus of claim 10 wherein the weighted member is immovably associated with the end.

13. The apparatus of claim 1 wherein the stop is selectively extendable with respect to the one of the first portion and the second portion.

14. The apparatus of claim 1 wherein the stop is offset with respect to a longitudinal axis of the second member.

15. The apparatus of claim 1 further comprising:

a third member engageable with the shade, insertable with respect to a second aperture defined by the first member, rotatable between at least a first angular position and a second angular position with respect to the first member, spaced from the second member, and having a first portion positionable adjacent the first side of the first member and a second portion positionable adjacent the second side of the first member; and a separate means for limiting rotation of the third member with respect to the first member.

16. The apparatus of claim 15 further comprising:

a first shade engageable with one of the first portion and second portion of the second member and movable between an extended position and a retracted position in response to rotation of the second member wherein the first position of the second member corresponds to one of the extended position and the retracted position and the second position of the second member corresponds to the other of the extended position and the retracted position; and a second shade engageable with one of the first portion and second portion of the third member and movable between an extended position and a retracted position in response to rotation of the third member wherein the first position of the third member corresponds to one of the extended position and the retracted position and the second position of the third member corresponds to the other of the extended position and the retracted position.

17. The apparatus of claim 15 further comprising:

means for concurrently rotating the second member with respect to the third member.

18. The apparatus of claim 1 wherein the second member further comprises:

a first annular surface engageable with the aperture; and a second annular surface engageable with said limiting means.

19. The apparatus of claim 18 wherein the first annular surface defines a first radius and the second annular surface defines a second radius and the first radius is different than the second radius.

20. The apparatus of claim 1 wherein said limiting means further comprises:

a brake for generating a force opposing motion of the second member relative to the first member, the force slightly greater than a maximum naturally occurring force tending to induce rotation of the second member relative to the first member.

21. An apparatus for positioning a shade along an arcuate path comprising:

a first member defining a first side, a second side and an aperture extending between the first and second sides;

a second member engageable with the shade, insertable with respect to the aperture, rotatable between at least a first angular position and a second angular position with respect to the first member, and having a first portion positionable adjacent the first side of the first member and a second portion positionable adjacent the second side of the first member; and means for limiting rotation of the second member with respect to the first member wherein the first member further comprises:

a first arcuate portion defining the first side, second side and aperture; and a second arcuate portion spaced from the first arcuate portion.

22. The apparatus of claim 21 wherein the first arcuate portion is substantially parallel to the second arcuate portion.

23. The apparatus of claim 21 wherein the first arcuate portion defines a first radius and the second arcuate portion defines a second radius where the first radius is substantially the same as the second radius.

24. The apparatus of claim 21 wherein the first arcuate portion defines a first radius and the second arcuate portion defines a second radius where the first radius is greater than the second radius.

25. The apparatus of claim 21 further comprising:

a shade engageable with one of the first portion and second portion and movable between an extended position and a retracted position in response to rotation of the second member wherein the first position corresponds to one of the extended position and the retracted position and the second position corresponds to the other of the extended position and the retracted position and positionable between the first and second arcuate portions.

26. The apparatus of claim 21 wherein the first arcuate portion is sized to substantially correspond to a size of a window.

27. An apparatus for positioning a shade comprising:

a first member defining a plane having first side, a second side and an aperture extending between the first and second sides, the plane spaced from a window in one of a wall and a door; wherein the shade is positionable between the plane and the window;

a second member engageable with the shade, insertable with respect to the aperture, rotatable between at least a first angular position and a second angular position with respect to the first member, and having a first portion positionable adjacent the first side of the first member and a second portion positionable adjacent the second side of the first member; and means for limiting rotation of the second member with respect to the first member, wherein the limiting means has a compressible member positionable between the first and second members and defining an annular channel having an opening traverse relative to a longitudinal axis of the second member.

28. The apparatus of claim 27 wherein said limiting means further comprises:

means for biasing the second member with respect to the first member disposed between the first member and second member adjacent one of the first side and the second side; and means for frictionally engaging the first member with respect to the second member disposed between the first member and second member adjacent the other of the first side and the second side.

29. The apparatus of claim 27 wherein said limiting means further comprises:

a plurality of compressible members concentrically disposed with respect to the second member, at least one member on each side of the plane.

30. An apparatus for positioning a shade comprising:

a first member defining a plane having first side, a second side and an aperture extending between the first and second sides, the plane spaced from a window in one of a wall and a door; wherein the shade is positionable between the plane and the window;

a second member engageable with the shade, insertable with respect to the aperture, rotatable between at least a first angular position and a second angular position with respect to the first member, and having a first portion positionable adjacent the first side of the first member and a second portion positionable adjacent the second side of the first member; and means for limiting rotation of the second member with respect to the first member, wherein the second member further comprises:

at least one finger extending from one of the first portion and the second portion and substantially transverse with respect to a longitudinal axis of the second member for engaging the shade.

31. An apparatus for positioning a shade comprising:

a first member defining a plane having first side, a second side and an aperture extending between the first and second sides, the plane spaced from a window in one of a wall and a door; wherein the shade is positionable between the plane and the window;

a second member engageable with the shade, insertable with respect to the aperture, rotatable between at least a first angular position and a second angular position with respect to the first member, and having a first portion positionable adjacent the first side of the first member and a second portion positionable adjacent the second side of the first member; and means for limiting rotation of the second member with respect to the first member, wherein said limiting means further comprises:

a stop extending from the one of the first portion and the second portion and substantially transverse with respect to a longitudinal axis of the second member for limiting a range of rotation of the second member relative to the first member.

32. The apparatus of claim 31 wherein the stop engages the first member only when the second member is at one of the first and second angular positions.

33. The apparatus of claim 32 wherein the stop is selectively moveable relative to the one of the first portion and the second portion.

34. The apparatus of claim 30 wherein said limiting means further comprises:

a brake for generating a force opposing motion of the second member relative to the first member, the force slightly greater than a maximum naturally occurring force tending to induce rotation of the second member relative to the first member; and a stop extending from the one of the first portion and the second portion and substantially transverse with respect to a longitudinal axis of the second member for limiting a range of rotation of the second member relative to the first member.

35. The apparatus of claim 30 further comprising:

an arcuate member defining a path adapted to substantially correspond to a perimeter of the window; and a sleeve defined by the shade for receiving the arcuate member.

36. The apparatus of claim 35 further comprising:

a guide positionable with respect to the at least one finger and defining an aperture for receiving the arcuate member.

* * * * *